US006461259B1

(12) United States Patent
Li

(10) Patent No.: US 6,461,259 B1
(45) Date of Patent: Oct. 8, 2002

(54) TABLE TENNIS BAT WITH ADJUSTING GRAVITY MECHANISM

(76) Inventor: Kuang Tsu Li, 1F H Pine Mansion, Pai-Koo Shing (HK)

( * ) Notice: Subject to any disclaimer, the term of this patent is extended or adjusted under 35 U.S.C. 154(b) by 0 days.

(21) Appl. No.: 09/948,689

(22) Filed: Sep. 10, 2001

(30) Foreign Application Priority Data

Sep. 13, 2000 (CN) ..... 00 2 50172

(51) Int. Cl.[7] ..... A63B 49/00
(52) U.S. Cl. ..... 473/527; 473/519; 473/549
(58) Field of Search ..... 473/463, 475, 473/527, 528, 529, 530, 519, 549, 550, 551, 552

(56) References Cited

U.S. PATENT DOCUMENTS

| | | | | | |
|---|---|---|---|---|---|
| 1,587,918 | A | * | 6/1926 | Morrison | 473/519 |
| 2,028,291 | A | * | 1/1936 | MacPherson | 473/47 |
| 4,324,400 | A | | 4/1982 | Tse | |
| 5,171,011 | A | | 12/1992 | Squadroni | |
| 5,316,296 | A | | 5/1994 | Ben-Zirma et al. | |
| 5,409,213 | A | * | 4/1995 | Yeh | 473/527 |
| 5,475,894 | A | | 12/1995 | Wildforster | |
| 2002/0032086 | A1 | * | 3/2002 | Li | 473/516 |

FOREIGN PATENT DOCUMENTS

| | | | | |
|---|---|---|---|---|
| DE | 2753192 | * | 6/1979 | 473/FOR 171 |
| DE | 2933299 | * | 3/1981 | 473/FOR 171 |
| DE | 3612992 | * | 10/1987 | 473/FOR 174 |
| DE | 29700541 | * | 6/1997 | A63B/49/12 |
| EP | 1494517 | | 12/1997 | |
| FR | 2521862 | * | 8/1983 | 473/FOR 183 |
| FR | 2620627 | * | 3/1989 | 473/FOR 171 |
| SU | 820857 | * | 4/1981 | 473/FOR 174 |

* cited by examiner

*Primary Examiner*—Raleigh W. Chiu
(74) *Attorney, Agent, or Firm*—Stevens, Davis, Miller & Mosher, LLP

(57) ABSTRACT

The table tennis bat with adjusting gravity mechanism of the present invention, whose center of gravity can be varied dependent on player's habitual behavior or usual practice to be suitable for each table tennis player's demand, comprises a blade body, an upper handgrip part, a lower handgrip part, an adjusting gravity mechanism, and an adjusting knob. Which adjusting gravity mechanism is included a hollow rectangular frame, a lead screw and a slider block. The slider block is used as counterweigh when removed capably to vary the center of gravity of table tennis bat of the present invention. Accordingly, when the slider block is driven to have a forward displacement the center of gravity of table tennis bat of the present invention is varied forward. Similarly, when the slider block is driven to have a backward displacement the center of gravity of table tennis bat of the present invention is varied backward. The distance of displacement of the slider block removed is obviously observed by table tennis player who can look at the slider block through a glass to moderately adjust the center of gravity of table tennis bat.

4 Claims, 3 Drawing Sheets

TABLE TENNIS BAT WITH ADJUSTING GRAVITY MECHANISM

BACKGROUND OF THE INVENTION

1. Field of the invention

The present invention relates to a table tennis bat whose center of gravity can be varied, and more particularly to a table tennis bat whose handle is provided with an adjusting gravity mechanism.

2. Description of the related art

As is known to all, the structure of tennis racquets is different from that of table tennis bats, but the choice of balance and weight of a racquet always posing a problem to the tennis player is the same. Especially, there are two types of griping table tennis bat, namely shake-hands grip and penholder grip, to be applied for different table tennis players who is with different physical conditions and habitual behavior and different usual practice.

Once a table tennis player happens to hardly adapt one's own table tennis bat, if the center of gravity of table tennis bat can not be correctly adjusted immediately to match the player, who will hardly control both the direction the ball travels and the amount of spin imparted to the ball. Unfortunately, the general table tennis bats used by table tennis players now are not provided whose center of gravity can be varied or correctly adjusted.

Thus, resulted in the demand of balance and weight of table tennis bat is more sensitive to different table tennis players who desires to enhance his skill to impart an elastic rebounding force to the ball thereby increasing the speed at which the ball left the bat.

SUMMARY OF THE INVENTION

The table tennis bat of this invention comprises a blade body, an upper handgrip part, a lower handgrip part, an adjusting gravity mechanism, and an adjusting knob, and adjusting gravity mechanism is included a hollow rectangular frame, a lead screw and a slider block. The slider block is used as counterweigh when removed capably to vary the center of gravity of table tennis bat of the present invention.

One primary aspect of this invention is to provide a table tennis bat whose center of gravity can be varied to be suitable for any table tennis player's demand and habit or usual practice.

Another aspect of this invention is invented a table tennis bat which handle is provided with an adjusting gravity mechanism inside can be used to adjust and vary the center of gravity of table tennis bat by rotating an adjusting knob.

A further aspect of this invention is that when an adjusting knob is rotated in counterclockwise rotation the center of gravity of table tennis bat of the present invention is varied forward and when said adjusting knob is rotated in clockwise rotation the center of gravity of table tennis bat of the present invention is varied backward.

One more aspect of this invention is the displacement of center of gravity removed is obviously observed by table tennis player who can look at through a glass to moderately adjust the center of gravity of table tennis bat of the present invention.

BRIEF DESCRIPTION OF THE DRAWINGS

The invention will be better understood by reference to the following drawings when reading the description of the invention contained herein.

DETAILED DESCRIPTION OF THE PREFERRED EMBODIMENTS

The features and advantages of this invention are described in this specification in conjunction with the drawings illustrating a preferred embodiment of the invention.

Figure 1:
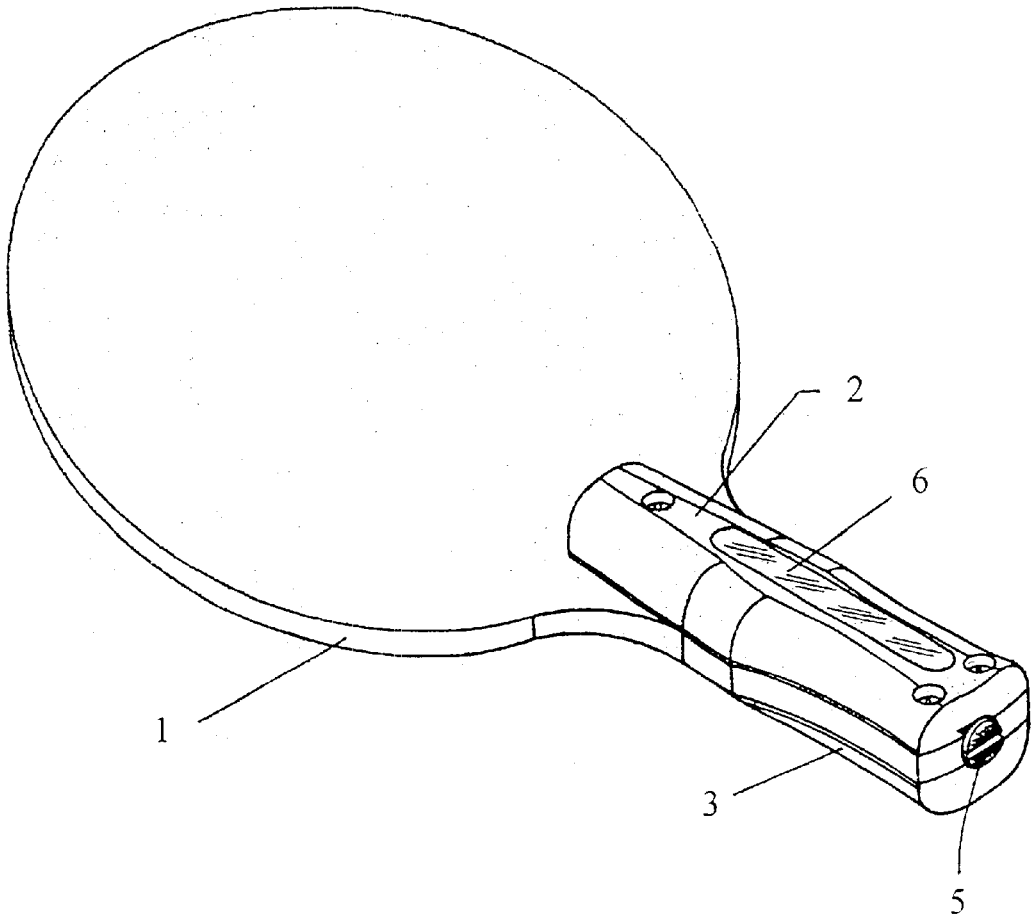
FIG. 1 is a solid drawing of table tennis bat of the present invention to illustrate whose appearance is same as usual to be but whose center of gravity can be varied.
Figure 2:
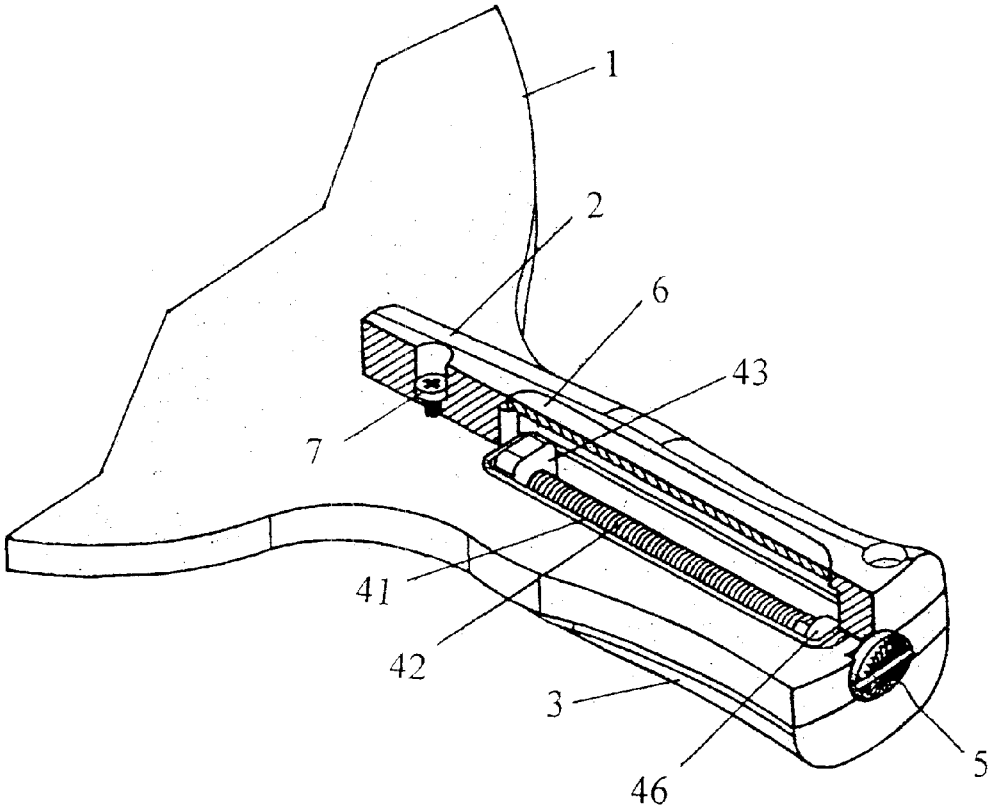
FIG. 2 is a partial cross section drawing of FIG. 1 to indicate an adjusting gravity mechanism with a slider block as counterweigh capably moved forward and backward by operation of lead screw turned in counterclockwise or clockwise rotation.

As shown in FIG. 1 and FIG. 2 a table tennis bat of this invention comprises a blade body 1, an upper handgrip part 2, a lower handgrip part 3, an adjusting gravity mechanism 4, and an adjusting knob 5. Said adjusting knob 5 is a key head bolt with round shaft whose end is formed flat key head on which surface a pin hole is provided.

Figure 3:
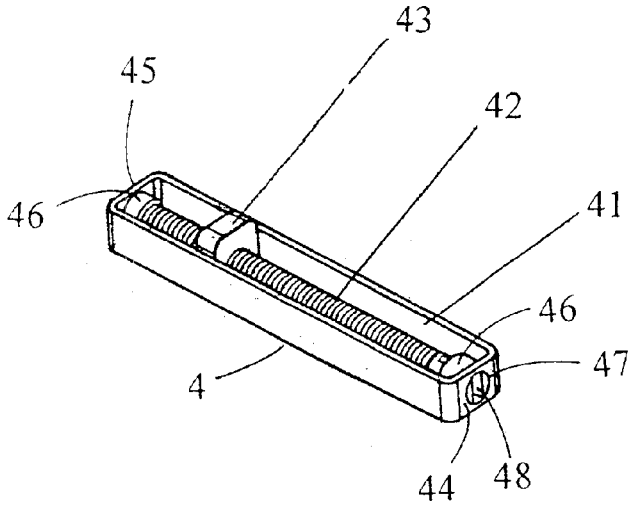
FIG. 3 is a schematic drawing of an adjusting gravity mechanism of the present invention.

Said adjusting gravity mechanism 4 is shown in FIG. 3 to include a hollow rectangular frame 41, a lead screw 42 and a slider block 43. Said hollow rectangular frame 41, which material is selected from metal or plastic material, has a capacity to provide said lead screw 42 and said slider block 43 capably installed inside. Each end 44, 45 of said hollow rectangular frame 41 is provided with a round hole 47 which diameter is slightly larger than that of said lead screw 42 so that said lead screw 42 is capably passed through said round hole 47. A key slot 48 is formed on the surface of one end of said lead screw 42 and over said key slot 48 a pin hole perpendicular to said key slot 48 is also formed. So that said key slot 48 of said lead screw 42 may provide said adjusting knob 5 with its flat key head inserted into, and then said lead screw 42 may be rotated when said slot 48 is rotated by said adjusting knob 5. Said slider block 43 used as counterweigh when removed capably to vary the center of gravity of table tennis bat is a square-like block which center has a thread hole matched to said lead screw 42.

When said adjusting gravity mechanism 4 is assembled as a whole, at first one end of said lead screw 42 is put through said round hole 47 of said end 44 of said hollow rectangular frame 41, then said slider block 43 is installed on the shaft of said lead screw 42 by rotating said lead screw 12 into thread hole of said slider block 43, and subsequently said end of said lead screw 42 is further put into said round hole 47 formed on the other end 45 of said hollow rectangular frame 41. Therefore, said slider block 43 has a forward and backward displacement by rotating said lead screw 42 in counterclockwise and clockwise rotation.

Another embodiment of said adjusting gravity mechanism 4 of the present invention is that both end of said lead screw 42 are put on rubber ring 46 (referring to FIG. 3) as screw collar when said lead screw 42 is installed inside the capacity of said hollow rectangular frame 41. Said rubber ring 46 is provided with pin hole which position is positioned to said pin hole of said lead screw 42 when assembled by pin.

Figure 4:
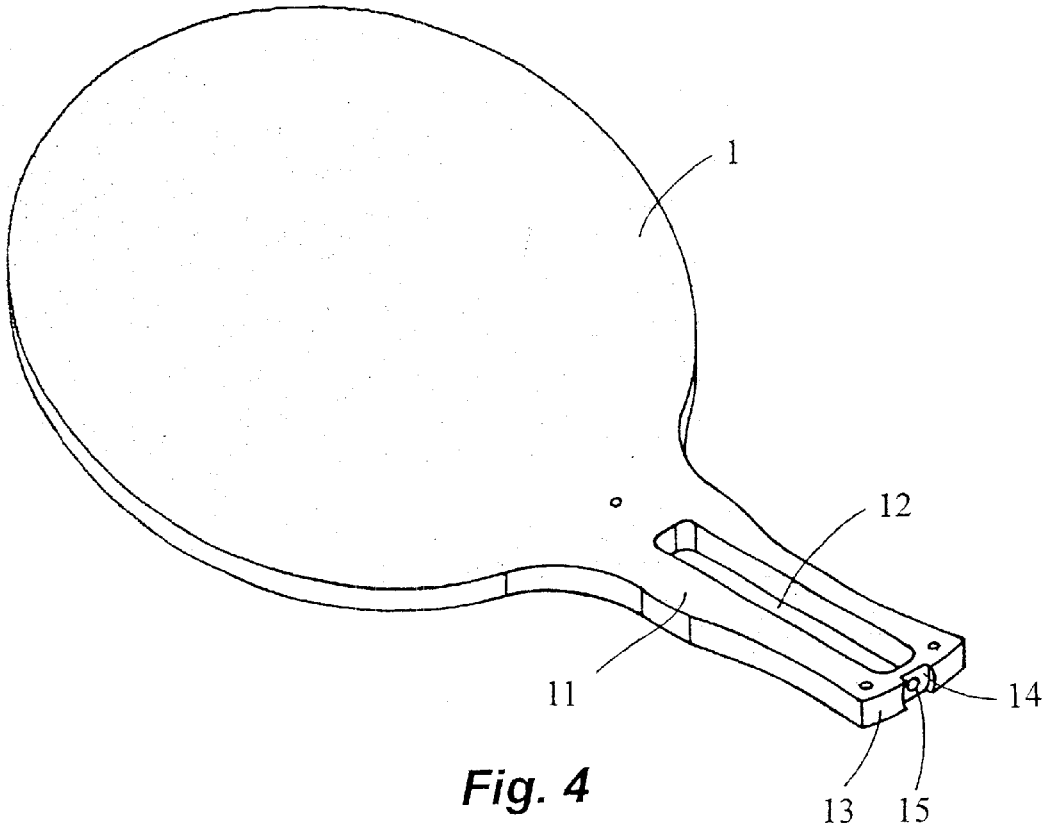
FIG. 4 is a schematic drawing of a blade body component of the present invention.

As shown in FIG. 4 said blade body 1 has a handle part 11 on which a rectangular hole 12 is formed to be provided a space for said hollow rectangular frame 41 of said adjusting gravity mechanism 4 put in there. On the front side end 13 of said hand part 11 is also provided with a middle recess 14 which center is penetrated through a hole 15 aligned the central line of said rectangular hole 12. Therefore, said hole 15 is interconnected to said rectangular hole 12. The diameter of said hole 15 is slightly larger than that of round shaft of said adjusting knob 5 so that said end with flat key head of said adjusting knob 5 may pass through said hole 15 and extend out of said hole 15.

Figure 5:
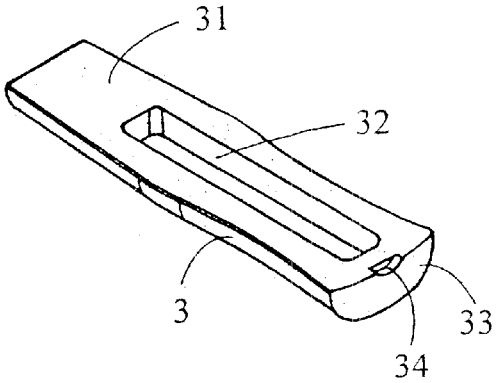
FIG. 5 is a schematic drawing of upper handgrip component of the present invention.

Referring to FIG. 5, said lower handgrip part 3 has a flat surface 31 which appearance of said flat surface 31 is identical to that of said handle part 11 of said blade body 1. On said flat surface 31 a rectangular recess 32 relative to said rectangular hole 12 of said blade body 1 is formed to have an enough space for said slider block 43 to be freely moved forward and backward therein. On the end 33 of said lower handgrip part 3 is also provided with a lower arc recess 34.

Figure 6:
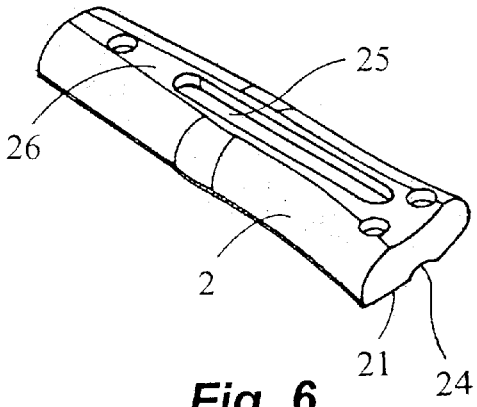
FIG. 6 is a schematic drawing of lower handgrip component of the present invention.

Referring also to FIG. 6, the structure of said upper handgrip part 2 generally symmetrical to that of said lower handgrip 3 has also a flat surface 21, a rectangular recess inside relative to said rectangular hole 12 of said blade body 1, and an upper arc recess 24. But on the surface 26 opposite to said flat surface 21 of said upper handgrip part 2 is provided with a recess 25 over its rectangular recess in which a glass 6 can be installed as shown in FIG. 1.

When proceeding to assemble table tennis bat of the present invention as shown in FIG. 1 and FIG. 2, which assembling steps is in accordance with the follows:

(a) assembling said adjusting gravity mechanism 4 first, which said lead screw 42 is taken to have one end of said lead screw 42 be put through said round hole 47 of said hollow rectangular frame 41, then to have said slider block 43 be installed on the shaft of said lead screw 42 by rotating said lead screw 12 into thread hole of said slider block 43, and subsequently to have same said end of said lead screw 42 be further put into said the other round hole 47 of said hollow rectangular frame 41 to complete said adjusting gravity mechanism 4;

(b) assembling said lower handgrip part 3 to said handle part 11 of said blade body 1, which said flat surface 31 of said lower handgrip part 3 is adhered to one side of said handle part 11 of said blade body 1 by adhesion connected or screw fastened together, so that said rectangular hole 12 of said blade body 1 may relatively superimposed on said rectangular recess 32 of said lower handgrip part 3 to constitute an enough space for said adjusting gravity mechanism 4 installed therein;

(c) installing said adjusting gravity mechanism 4 into said rectangular hole 12 of said blade body 1, in which said hollow rectangular frame 41 of said adjusting gravity mechanism 4 is put inside said rectangular hole 12 of said handle part 11 of said blade body 1 and part of said slider block 42 of is then positioned into said rectangular recess 32 of said lower handgrip part 3 to make said slider block 43 have a forward and backward displacement by rotating said lead screw 42 in counterclockwise and clockwise rotation;

(d) assembling said adjusting knob 5 to said handle part 11 of said blade body 1 already installed of said adjusting gravity mechanism 4, which said adjusting knob 5, whose end with flat key head may pass through said hole 15 of said handle part 11 of said blade body l and extend out of said hole 15 to insert into said key slot 48 of said lead screw 42 of said adjusting gravity mechanism 4, is then positioned into said middle recess 14 of said handle part 11 of said blade body land said lower arc recess 34 of said lower handgrip part 3;

(e) by pin jointing to fasten said key slot 48 of said lead screw 42 and said flat key head of said adjusting knob 5 together, which a pin is passed through said pin hole of said lead screw 42 perpendicular to said key slot 48 and that pin hole of said adjusting knob 5 formed on the surface of flat key head of said adjusting knob 5 so that said lead screw 42 and said adjusting knob 5 is connected together to prevent said adjusting knob 5 from removing away from said blade body 1; and further (f) assembling said upper handgrip part 2 to the other side of said handle part 11 of said blade body 1 to complete whole assembly of table tennis bat of the present invention, which said flat surface 21 of said upper handgrip part 2 in advance installed a said glass 6 on said recess 25 is faced to the other side of said handle part 11 of said blade body 1 and by screw 7 said upper handgrip part 2 is then fastened to said blade body 1 as a whole table tennis bat of the present invention.

Accordingly, to be suitable for each table tennis player's demand and habit or usual practice, the table tennis bat of the present invention which handle is provided with an adjusting gravity mechanism inside can be used to adjust and vary center of gravity of table tennis bat. When said adjusting knob 5 is rotated in counterclockwise rotation, said slider block 43 has a forward displacement due to said lead screw 42 being driven to have a counterclockwise rotation synchronously so that the center of gravity of table tennis bat of the present invention is varied forward. Similarly, when said adjusting knob 5 is rotated in clockwise rotation, said slider block 43 has a backward displacement due to said lead screw 42 being driven to have a clockwise rotation synchronously so that the center of gravity of table tennis bat of the present invention is varied backward. The distance of displacement of said slider block 43 removed is obviously observed by table tennis player who can look at said slider block 43 through said glass 6 to moderately adjust the center of gravity of table tennis bat of the present invention.

What I claim is:

1. A table tennis bat with adjusting gravity mechanism comprising:

an adjusting gravity mechanism, which includes a hollow rectangular frame, a lead screw and a slider block; said slider block is a square-like block which center has a thread hole matched to said lead screw to be used as counterweigh when removed capably to vary the center of gravity of table tennis bat; said lead screw is provided to have said slider block be installed on its shaft, and on the surface of one end of said lead screw a key slot is formed; and said hollow rectangular frame has a capacity to provide said lead screw and said slider block installed inside, and each ends of said hollow rectangular frame with a round hole capably passed through by said lead screw;

a blade body, which has a handle part on which a rectangular hole is formed to be provided a space for said hollow rectangular frame of said adjusting gravity mechanism put in there; and on the front side end of said hand part with a middle recess which center is penetrated through a hole interconnected to said rectangular hole to provide said adjusting knob with flat key head to pass through said hole and extend out;

a lower handgrip part, which has a flat surface with identical appearance to that of said handle part of said blade body and on which said flat surface a rectangular recess relative to said rectangular hole of said blade body is formed; and on the end of said lower handgrip part is also provided with a lower arc recess;

an upper handgrip part, which structure generally symmetrical to that of said lower handgrip also has a flat surface, a rectangular recess inside relative to said rectangular hole of said blade body, and an upper arc recess; and on the surface opposite to said flat surface of said upper handgrip part is provided with a recess to provide a glass installed thereon;

an adjusting knob, which is a key head bolt with round shaft whose end is formed flat key head, and said adjusting knob with its flat key head is to be passed through and extended out of said hole of said blade body and to be inserted into said key slot of said lead screw of said adjusting gravity mechanism and then by pin jointing connected together; and a glass, which is installed on said recess of said upper handgrip part so that distance of displacement of said slider block removed is obviously observed.

2. The table tennis bat with adjusting gravity mechanism according to claim 1, wherein which material of said hollow rectangular frame of said adjusting gravity mechanism is selected from metal or plastic material.

3. The table tennis bat with adjusting gravity mechanism according to claim 1, wherein end of said lead screw of said adjusting gravity mechanism is put on rubber ring as screw collar.

4. The table tennis bat with adjusting gravity mechanism according to claim 1, wherein said lower handgrip part and said upper handgrip part connected to said blade body is by use of adhesive agent or screws.

* * * * *